US005509789A

United States Patent [19]

Segebrecht et al.

[11] Patent Number: 5,509,789

[45] Date of Patent: Apr. 23, 1996

[54] LIQUID RING PUMP HAVING A SHEET METAL WORKING CHAMBER CASING

[75] Inventors: Udo Segebrecht, Heiligenstedten; Klaus Domagalla, Nutteln, both of Germany

[73] Assignee: SIHI GmbH & Co KG, Itzehoe, Germany

[21] Appl. No.: 304,534

[22] Filed: Sep. 12, 1994

[30] Foreign Application Priority Data

Sep. 16, 1993 [DE] Germany ..... 43 31 489.9
Apr. 20, 1994 [EP] European Pat. Off. ..... 94106156

[51] Int. Cl.[6] ..... F04C 19/00; F04B 53/16

[52] U.S. Cl. ..... 417/68; 417/DIG. 1; 29/888.025

[58] Field of Search ..... 417/68, 69, DIG. 1; 29/888.02, 888.022, 888.023, 888.025

[56] References Cited

U.S. PATENT DOCUMENTS

| | | | |
|---|---|---|---|
| 3,702,745 | 11/1972 | Segebrecht | 417/68 |
| 3,849,024 | 11/1974 | Masai et al. . | |
| 4,278,409 | 7/1981 | Eiermann | 29/888.025 |
| 4,674,960 | 6/1987 | Rando et al. | 29/888.023 |

FOREIGN PATENT DOCUMENTS

| | | | |
|---|---|---|---|
| 0159968A2/A3 | 10/1985 | European Pat. Off. . | |
| 0389838A2/A3 | 10/1990 | European Pat. Off. . | |
| 910327 | 4/1954 | Germany | 417/68 |
| 2731451B1 | 4/1978 | Germany . | |
| 2731451 | 4/1978 | Germany | 417/68 |
| 512688 | 9/1939 | United Kingdom | 417/68 |
| 1412445 | 11/1975 | United Kingdom | 417/68 |

*Primary Examiner*—Richard A. Bertsch
*Assistant Examiner*—Roland G. McAndrews, Jr.
*Attorney, Agent, or Firm*—Chilton, Alix & Van Kirk

[57] ABSTRACT

Single-stage liquid ring gas pump which can be flanged to a drive unit. The suction and delivery connections are disposed on a connection casing (3) which is to be connected to the drive unit. On the side of the connection casing remote from the drive are disposed a plate cam (4) and a working chamber casing (5) together with the impeller (14) rotating in the latter. The impeller sealingly cooperates on its open end face with the plate cam and on its largely closed end face (19) with an end wall (7) of the working chamber casing (5). The working chamber casing is in the form of a deep-drawn sheet metal part and has no medium connections. For the purpose of connection to the connection casing or the plate cam, it is provided with a radial connection flange (6). The transition from the cylindrical part to the connection flange (6) of the working chamber casing (5) is rounded on the inside such that the gap remaining between this rounding and the plate cam remains below a particular size. Its incircle should not be larger than 3.5% of the diameter of the impeller.

4 Claims, 2 Drawing Sheets

LIQUID RING PUMP HAVING A SHEET METAL WORKING CHAMBER CASING

The invention relates to a liquid ring gas pump that can be flanged to a drive unit.

In a known pump of this type (Hick Hargreaves leaflet: "CHR Series Liquid Ring Pumps") the pump comprises a connection casing which is flanged to the drive motor and which forms the suction and delivery connections, a pot-shaped working chamber casing which has a flange for connection to a flange of the connection casing, and a plate cam arranged between these two casings. All casing parts are sturdily dimensioned castings. This is customary for liquid ring gas pumps because their efficiency is largely dependent on the maintenance of slight clearance between the impeller and the working chamber casing and this clearance must not be impaired by deformation of the casing. This is also the reason why the less expensive sheet metal construction, which has long been employed in other types of pump, has not yet found acceptance for liquid ring gas pumps.

The object on which the invention is based is that of achieving more economical manufacture of liquid ring gas pumps without loss of quality. This is mainly achieved by constructing the working chamber casing in the form of a pot-shaped, deep-drawn sheet metal part having no connections.

In the genesis of the invention it was necessary to overcome the preconception that comparatively thin-walled sheet metal components cannot ensure the close tolerances in respect of impeller clearance. These are necessary between the end faces of the impeller and the casing parts cooperating with it, namely the plate cam on the one side and the end wall of the working chamber casing on the other side, to ensure that the overflow from the vane cells under higher pressure to cells under lower pressure does not lead to losses of efficiency.

With a comparatively thin-walled construction of the bottom of the working chamber casing when sheet metal is used, greater deformation must indeed be expected than with a corresponding casting. However, the invention has realized that for two reasons this can be disregarded. In the first place, the impeller, which between the vanes forms cells open towards the plate cam, is largely closed on the side remote from the plate cam by an end disc or a radial widening of the hub; the overflow paths on this side are therefore longer than on the side which cooperates with the plate cam, so that greater clearance can be tolerated. Secondly, an axial thrust in the direction of the plate cam acts on the impeller, so that any increased bearing clearance does not increase the critical gap width between the impeller and the plate cam, but at most increases the less critical clearance between that end face of the impeller which is remote from the plate cam and the bottom of the working chamber casing. The medium connections are disposed in the connection casing, to ensure that the working chamber casing cannot be distorted by distortion during manufacture or through the action of forces during use. This also applies to the emptying opening and to the feeding of operating liquid.

It is true that in a side-channel fan it is known for the casing enclosing the impeller to be partly made in the form of a deep-drawn sheet metal part (DE-B 23 31 614); however, the invention could not be suggested thereby, because in the known pump the casing does not cooperate with the impeller to form a working chamber and therefore does not have to form a close clearance with it. Those versed in the art could therefore only learn from this that, as they already knew, sheet metal construction can lead to a reduction of the cost of the casing. They did not learn how they could overcome the special difficulties which are encountered when sheet metal construction is applied to liquid ring gas pumps.

The working chamber casing advantageously has an essentially radial connection flange for connection to the connection casing, said flange being integral with the remainder of the working chamber casing. This gives rise to the problem that the manufacturing process produces, at the transition from the cylindrical part of the casing to the flange, a rounding which forms a circumferential gap next to the plate cam. However, it is endeavoured to allow at the so-called apex of the casing, where the outer edges of the impeller come closest to the periphery of the casing, the shortest possible distance in order to keep at a low level the overflow losses caused by the overflow of liquid from one cell to the nearest cell at a lower pressure. The gap formed at the rounding in the sheet metal casing constitutes an additional overflow cross-section. A remedy can be found for this by providing the outer edges of the impeller at this point with a projection penetrating into the gap. The invention has however realized that this expense is unnecessary, provided that the size of the gap does not exceed a certain cross-sectional area. More accurately expressed, what mainly matters is that region of the gap which is situated nearer the impeller and which has a greater width than the part of the gap situated further towards the outside. The cross-sectional area of the gap, as such, is therefore less significant than the size of the incircle which can be inscribed in the cross-sectional area of the gap, as is indicated in claims 3 and 4. This incircle diameter should not exceed 1.5 times, and preferably 0.85 times, the wall thickness of the working chamber casing. In the case of pumps having the customary impeller diameter (for example 125 to 210 mm diameter, speed of rotation 3000 $min^{-1}$), more generally speaking, it should not be greater than 3.5%, preferably 2.5%, of the diameter of the impeller.

Particles of dirt which pass into the liquid ring and have a higher density than the liquid are caught in the liquid ring and orbit on its outer periphery. It is known to provide in the plate cam a dirt removal opening on the outer periphery of the liquid ring, through which opening a part of the liquid can pass out of the liquid ring together with the particles. The particles of dirt collect preferentially in the gap between the rounding in the working chamber casing and the plate cam. It is therefore expedient for the dirt removal opening to be arranged at this gap, that is to say at least adjacent the same, but preferably entirely or partly radially outside the inside diameter of the cylindrical part of the working chamber casing.

When in the context of the invention reference is made to deep-drawing of the working chamber casing, deformation by means of rigid shaping tools moved axially relative to one another is primarily meant; however, the expression should also include other, related shaping techniques, such as spinning, stretch-forming and high-speed forming.

When mention is made of thin-walled construction of the working chamber casing, this means an order of magnitude of 3 to 8 mm, preferably 4 to 6 mm, with an impeller diameter of 125 to 210 mm. For larger pumps a correspondingly greater thickness is used.

The invention is explained in more detail below with reference to the drawing, which illustrates an advantageous exemplary embodiment and in which.

Figure 1:
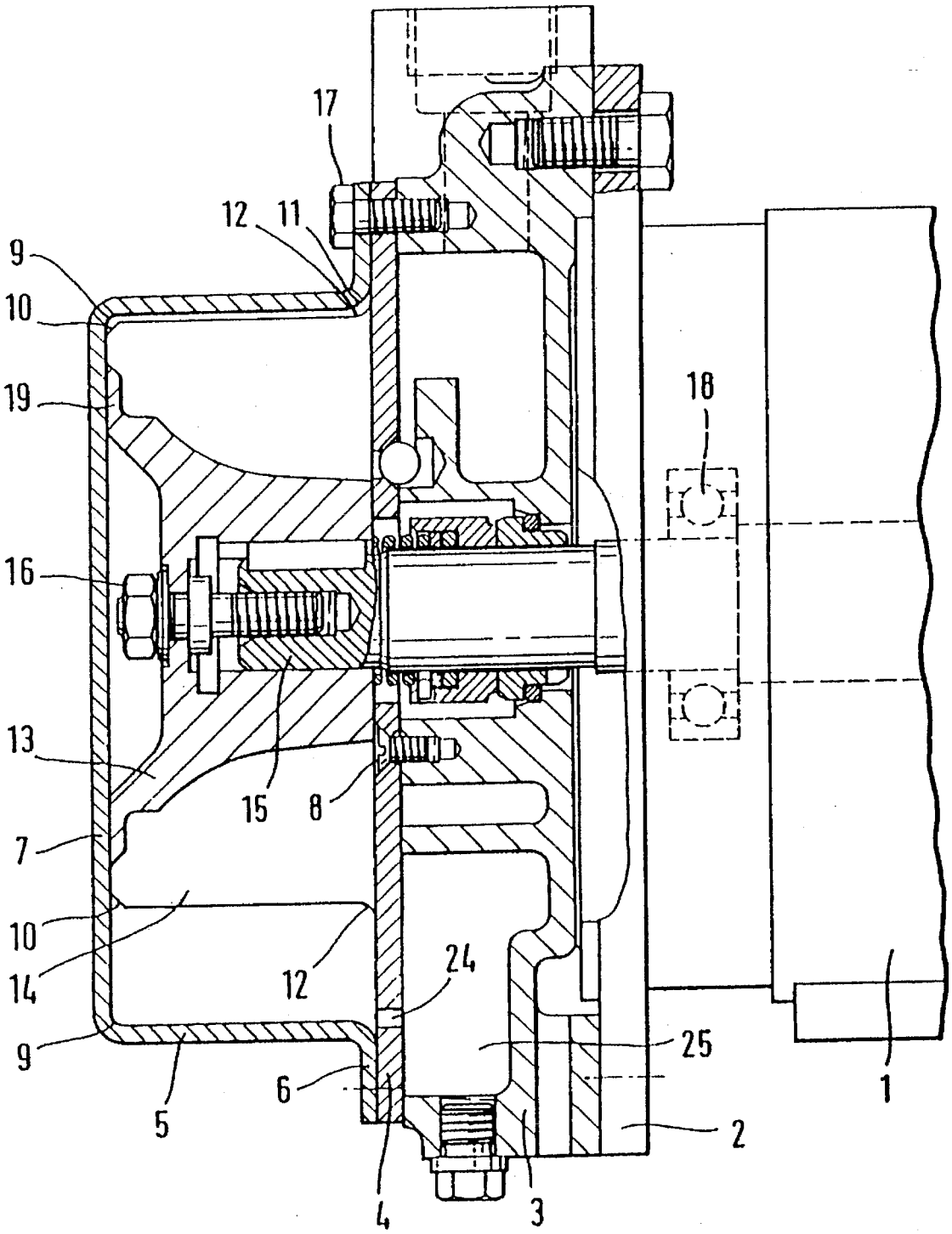
FIG. 1 shows a longitudinal section through the pump.

Connected to the motor 1 (or to a bearing support, a canned drive or the like) by means of the flange 2 is the connection casing 3, which contains the suction and delivery chamber of the pump and also the suction and delivery connection pieces leading to the outside. There follow the plate cam 4, which contains the suction and delivery openings (not shown), and, adjacent the same, the working chamber casing 5 with the connection flange 6 and the casing wall 7 remote from the drive. The connection flange 6 is connected to the connection casing 3 by means of the screws 17 with the interposition of the plate cam 4. The plate cam 4 is fastened to the connection casing 3 by additional screws 8. Both the centring of the flange 6 and the centring of the plate cam 4 in relation to the connection casing 3 can be effected by providing appropriate close tolerances for the bores in the flange 6 and in the plate cam 4 for two of the screws 17.

The impeller 13, provided with vanes 14, rotates in the working chamber casing 5, said impeller being fastened on the shaft end 15 and being adjustable in the longitudinal direction by means of the screw 16 in order to maintain the intended clearance relative to the plate cam 4 and the casing wall 7 remote from the motor. The shaft is mounted longitudinally fast in that bearing 18 of the motor 1 which is closer to the pump. It is not advisable for that bearing of the motor 1 which is remote from the pump to be in the form of a fixed bearing, because otherwise thermal expansion of the motor shaft may influence the position of the impeller.

The face seal, whose spring is supported on the impeller 13, is disposed inside the connection casing 3.

While the hub of the impeller decreases in diameter in the direction of the plate cam 4, in order to permit easy filling and emptying of the vane cells through the control openings of the plate cam 4, the hub diameter increases in the direction of the side remote from the drive and finally widens into an end disc 19, which cooperates with slight clearance with the plane casing wall 7. The latter and also the connection surface of the flange 6 may (but need not necessarily) be faced. However, it is to be expected that under the different pressures in the working chamber it will be slightly deformed and therefore that varying and possibly increased clearance will occur at this point. The axial thrust acting on the impeller acts in the same sense within the clearance made available by the bearing 18. Nevertheless, it need not be expected that between the impeller and the casing wall 7 overflow losses will occur which are of consequence in comparison with the corresponding losses on the other end face of the impeller, since the overflow paths are longer because of the impeller disc 19.

The deep-drawing process used for the production of the working chamber casing 5 has the consequence that the casing edges become rounded at 9 and 11. This can be taken into account by providing the outer vane corner 10 with a corresponding rounding or bevel. However, a configuration is preferred in which, in the course of the facing of the casing wall 7, the rounding of the casing corner 9 is recessed as much as is required by the diameter of the impeller.

In order to prevent the casing rounding 11 on the plate cam side from forming an undesirably large overflow cross-section, the vanes of the impeller may have a radial projection at this point, in the manner shown at 12. However, it has been found that this projection can be dispensed with, practically without sacrificing efficiency, if the radius 20 of the rounding 11 is made small enough, so that the area of the gap 21 between the rounding 11, the plate cam 4 and the line 22, which extends the cylindrical part of the casing 5 and is parallel to the outer edges of the vanes 14 (that is to say approximately parallel to the axis), is small enough. Since it is the parts of this area which are nearer the axis that are decisive in this context, the size of the incircle 23 inscribed in this area is used as measurement and its diameter must not exceed the values indicated previously.

With an impeller diameter of 125 mm, the original thickness of the sheet metal of the working chamber casing 5 preferably amounts to approximately 4 mm, and with an impeller diameter of 210 mm preferably amounts to approximately 6 mm.

Figure 2:
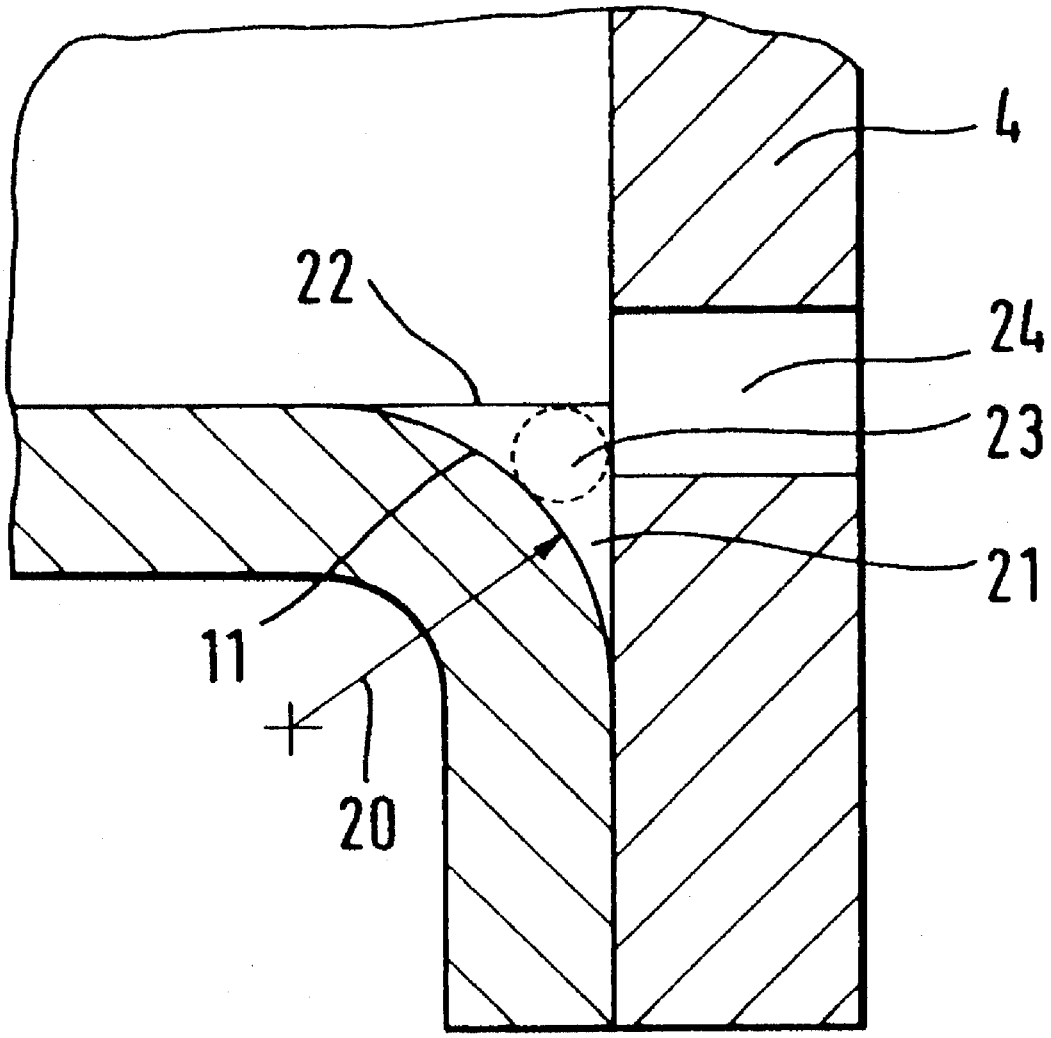
FIG. 2 shows an enlarged longitudinal section through the transition region from the cylindrical part of the working chamber casing to the flange of the latter.

Near the gap 21 a bore 24 leading into a special chamber 25 of the connection casing is arranged in the plate cam 4. It is arranged such that it at least adjoins the line 22, but, better still, as shown in FIG. 2, is situated at least partly radially outside this line. Particles of dirt collecting in the gap 21, together with a part of the liquid, can pass out of the working chamber through the bore 24 and into the chamber 25, in which they can be deposited or from which they can also be removed from time to time.

We patent claim:

1. A liquid ring gas pump comprising a connection casing (3) having suction and delivery connections, a plate cam (4) adjoining the connection casing (3), a working chamber casing (5) and a rotating impeller (14) mounted overhung in the working chamber casing and cooperating with the plate cam (4), said working chamber casing (5) being arranged remote from a drive unit (1), the working chamber casing (5) being a deep-drawn sheet metal part and having an essentially cylindrical wall and a connection flange (6) extending outwardly therefrom to form a curved inside transition (11) from the essentially cylindrical wall of the working chamber casing (5) to the connection flange (6) whereby a spandrel area (21) is formed between the curved inside transition (11 ), the plate cam (4) and a line (22) parallel to the impeller edge, said spandrel area extending the boundary of the working chamber and being of a size whereby the diameter of an incircle (23) inscribed in said spandrel area is not larger than 1.5 times the wall thickness of the working chamber casing.

2. The liquid ring gas pump as claimed in claim 3, wherein a dirt removal opening (24) is arranged in the plate cam (4) such that it at least adjoins the spandrel area (21) and lies at least partly radially outside the inside surface of the cylindrical wall of the working chamber casing.

3. A liquid ring gas pump comprising a connection casing (3) having suction and delivery connection, a plate cam (4) adjoining the connection casing (3), a working chamber casing (5) and a rotating impeller (14) mounted overhung in the working chamber casing and cooperating with the plate cam (4), said working chamber casing (5) being arranged remote from a drive unit (1), the working chamber casing (5) being a deep-drawn sheet metal part and having an essentially cylindrical wall and a connection flange (6) extending outwardly therefrom to form a curved inside transition (11) from the essentially cylindrical wall of the working chamber casing (5) to the connection flange (6) whereby a spandrel area (21) is formed between the curved inside transition (11), the plate cam (4) and a line (22) parallel to the impeller edge, said spandrel area extending the boundary of the working and being of a size whereby the diameter of an incircle (23) inscribed in said spandrel area is not greater than 3.5% of the diameter of the impeller.

4. The liquid ring gas pump as claimed in claim 4, wherein a dirt removal opening (24) is arranged in the plate cam (4) such that it at least adjoins the spandrel area (21) and lies at least partly radially outside the inside surface of the cylindrical wall of the working chamber casing.

* * * * *